US009753416B2

(12) United States Patent
Okamoto

(10) Patent No.: US 9,753,416 B2
(45) Date of Patent: Sep. 5, 2017

(54) FIXING DEVICE INCLUDING A GUIDE HAVING A ROUGHENED FACE AND IMAGE FORMING APPARATUS

(71) Applicant: Jun Okamoto, Tokyo (JP)

(72) Inventor: Jun Okamoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/149,558

(22) Filed: May 9, 2016

(65) Prior Publication Data

US 2016/0349677 A1 Dec. 1, 2016

(30) Foreign Application Priority Data

May 25, 2015 (JP) ..... 2015-105676

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322, 400
See application file for complete search history.

(56) References Cited

U.S. PATENT DOCUMENTS 6,937,840 B2 * 8/2005 Chung ..... G03G 15/2028 399/400
9,026,020 B2 * 5/2015 Chikugo ..... G03G 15/2028 399/322
2005/0180786 A1 8/2005 Yamada et al.
2009/0010687 A1 1/2009 Yamada et al.
2013/0004222 A1 1/2013 Sakaya et al.

FOREIGN PATENT DOCUMENTS

| | | |
|---|---|---|
| JP | 64-014766 | 1/1989 |
| JP | 2-272591 | 11/1990 |
| JP | 3-056753 | 5/1991 |
| JP | 2001-066931 | 3/2001 |
| JP | 2004-117992 | 4/2004 |
| JP | 2005-156905 | 6/2005 |
| JP | 2010-211229 | 9/2010 |
| JP | 2013-015551 | 1/2013 |
| JP | 2014-219553 | 11/2014 |

* cited by examiner

*Primary Examiner* — William J Royer

(74) *Attorney, Agent, or Firm* — Harness, Dickey & Pierce P.L.C.

(57) ABSTRACT

A fixing device includes a fixing rotator rotatable in a predetermined direction of rotation and a pressure rotator to press against the fixing rotator to form a fixing nip between the fixing rotator and the pressure rotator, through which a recording medium bearing a toner image is conveyed. A guide is disposed upstream from the fixing nip in a recording medium conveyance direction to guide the recording medium to the fixing nip. The guide includes a projection extending in the recording medium conveyance direction, a contact face to come into contact with the recording medium, and a roughened face disposed on at least a part of the contact face.

24 Claims, 8 Drawing Sheets

FIG. 4
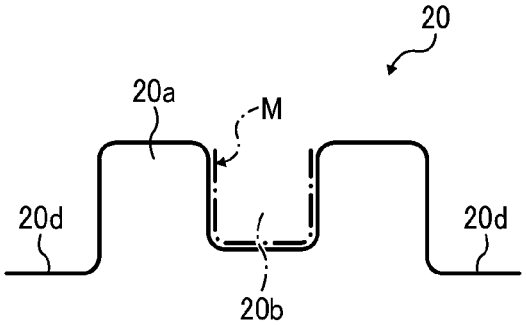
FIG. 5
| SURFACE ROUGHNESS (μm) | 0.3 | 0.5 | 1.0 | 3.0 |
|---|---|---|---|---|
| REDUCTION OF IMAGE DUST | POOR | FAIR | GOOD | GOOD |
FIG. 6
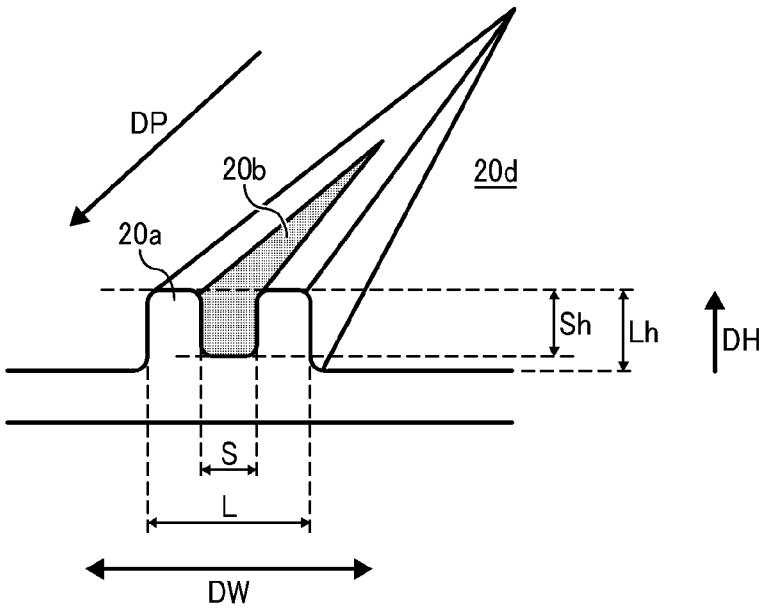

| MATERIAL OF PROJECTION | EMBOSS PROCESSING | REDUCTION OF IMAGE DUST |
|---|---|---|
| LCP | YES | GOOD |
| | NO | POOR |
| PET | YES | GOOD |
| | NO | GOOD |

| HEIGHT OF PROJECTION (mm) | CREASING | IMAGE SCRATCH |
|---|---|---|
| 0 | YES | NO |
| 0.5 | NO | NO |
| 1.0 | NO | NO |
| 1.5 | NO | NO |
| 2.0 | NO | YES |

ALLOWABLE RANGE

FIXING DEVICE INCLUDING A GUIDE HAVING A ROUGHENED FACE AND IMAGE FORMING APPARATUS

CROSS-REFERENCE TO RELATED APPLICATION

This patent application is based on and claims priority pursuant to 35 U.S.C. §119 to Japanese Patent Application No. 2015-105676, filed on May 25, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator to press against the fixing rotator to form a fixing nip between the fixing rotator and the pressure rotator, through which a recording medium bearing a toner image is conveyed. A guide is disposed upstream from the fixing nip in a recording medium conveyance direction to guide the recording medium to the fixing nip. The guide includes a projection extending in the recording medium conveyance direction, a contact face to come into contact with the recording medium, and a roughened face disposed on at least a part of the contact face.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and a pressure rotator to press against the fixing rotator to form a fixing nip between the fixing rotator and the pressure rotator, through which the recording medium bearing the toner image is conveyed. A guide is disposed upstream from the fixing nip in the recording medium conveyance direction to guide the recording medium to the fixing nip. The guide includes a projection extending in the recording medium conveyance direction, a contact face to come into contact with the recording medium, and a roughened face disposed on at least a part of the contact face.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein:

FIG. 4 is a cross-sectional view of the guide depicted in FIG. 3 illustrating a projection and a groove incorporated therein;

FIG. 5 is a lookup table illustrating a relation between a surface roughness of a roughened face of the guide illustrated in FIG. 4 and a degree of reduction of image dust;

FIG. 6 is a perspective view of the projection and the groove illustrated in FIG. 4;

DETAILED DESCRIPTION OF THE DISCLOSURE

Figure 1:
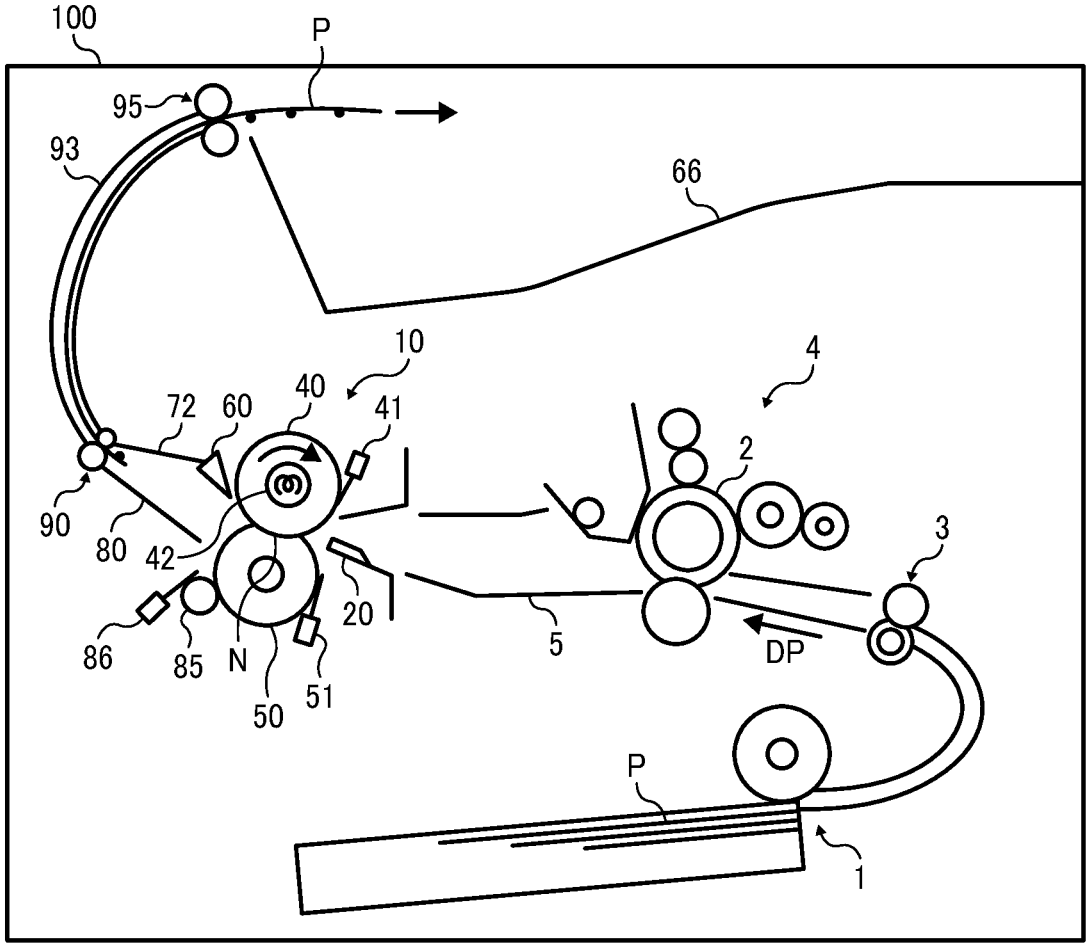
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a monochrome printer that forms a monochrome toner image on a recording medium by electrophotography. Alternatively, the image forming apparatus 100 may be a color printer that forms a color toner image on a recording medium.

A description is provided of a construction of the image forming apparatus 100.

As illustrated in FIG. 1, the image forming apparatus 100 includes an image forming device 4 and a fixing device 10 disposed downstream from the image forming device 4 in a recording medium conveyance direction DP. For example, the image forming device 4 includes a photoconductor 2, a transfer device, a separator, and a cleaner. The photoconductor 2 is surrounded by a charger, an exposure device, a developing device that contains toner, a photoconductor cleaner, and a discharger. FIG. 1 illustrates the drum-shaped photoconductor 2. Alternatively, the photoconductor 2 may be a belt.

Upstream from the image forming device 4 in the recording medium conveyance direction DP is a paper tray serving as a recording medium holder that loads a plurality of recording media P and a sheet feeder 1 that picks up and feeds an uppermost recording medium P from the plurality of recording media P loaded on the paper tray to a registration roller pair 3. The registration roller pair 3 conveys the recording medium P to the image forming device 4.

The image forming device 4 transfers a toner image formed on the photoconductor 2 onto the recording medium P. The recording medium P is conveyed to a conveyor 5 while the recording medium P electrostatically attracts toner of the toner image. The conveyor 5 conveys the recording medium P to a guide 20 that guides the recording medium P to the fixing device 10.

The fixing device 10 includes a heater 42, a fixing roller 40 heated by the heater 42, a pressure roller 50, and a cleaning roller 85. As the recording medium P bearing the unfixed toner image is conveyed through a fixing nip N formed between the fixing roller 40 and the pressure roller 50, the fixing roller 40 and the pressure roller 50 fix the toner image on the recording medium P. Downstream from the fixing nip N in the recording medium conveyance direction DP is a separation claw 60 that separates the recording medium P from the fixing roller 40.

The separation claw 60 separates the recording medium P bearing the fixed toner image from the fixing roller 40. An exit guide pair constructed of a lower guide 80 and an upper guide 72 guides the recording medium P to an exit roller pair 90.

The exit roller pair 90 conveys the recording medium P to an output guide 93 that guides the recording medium P to an output roller pair 95. The output roller pair 95 ejects the recording medium P onto an output tray 66 such that the fixed toner image on the recording medium P faces down.

Figure 2:
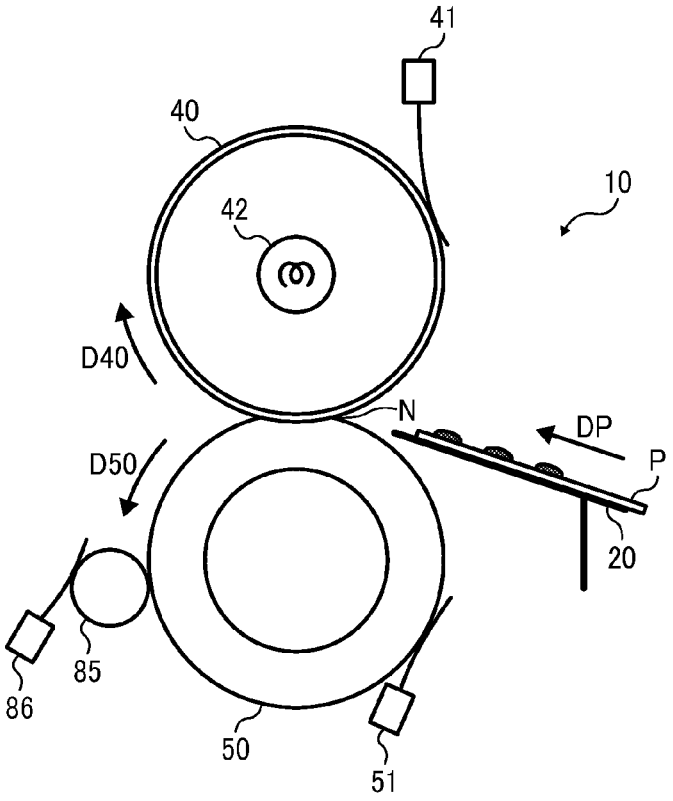
FIG. 2 is a schematic vertical cross-sectional view of a fixing device incorporated in the image forming apparatus illustrated in FIG. 1.

Referring to FIG. 2, a description is provided of a construction of the fixing device 10 incorporated in the image forming apparatus 100 having the construction described above.

FIG. 2 is a schematic vertical cross-sectional view of the fixing device 10. As illustrated in FIG. 2, the fixing device 10 (e.g., a fuser or a fusing unit) includes the fixing roller 40 serving as a fixing rotator or a fixing member rotatable in a rotation direction D40 and the pressure roller 50 serving as a pressure rotator or a pressure member rotatable in a rotation direction D50 and pressed against the fixing roller 40 to form the fixing nip N therebetween. As the recording medium P bearing the unfixed toner image is conveyed through the fixing nip N, the fixing roller 40 and the pressure roller 50 fix the toner image on the recording medium P under heat and pressure. Upstream from the fixing nip N in the recording medium conveyance direction DP is the guide 20 that guides the recording medium P to the fixing nip N.

A detailed description is now given of a construction of the pressure roller 50.

The pressure roller 50 is a tube or a cylinder constructed of a rigid shaft and an elastic layer coating the shaft. The shaft is made of metal such as iron and aluminum, resin that enhances the mechanical strength of the pressure roller 50, or the like. The elastic layer is a tube made of silicone rubber, tetrafluoroethylene-perfluoroalkylvinylether copolymer (PFA), or the like that facilitates separation of the recording medium P from the pressure roller 50. The pressure roller 50 is rotatably supported by a mount such as a frame.

The cleaning roller 85, a temperature sensor 86, and a pressure roller temperature sensor 51 are disposed in proximity to the pressure roller 50. The cleaning roller 85 serves as a cleaner that cleans an outer circumferential surface of the pressure roller 50. The temperature sensor 86 detects the temperature of the cleaning roller 85. The pressure roller temperature sensor 51 detects the temperature of the pressure roller 50.

A detailed description is now given of a construction of the fixing roller 40.

The fixing roller 40 is constructed of a tube made of metal such as iron and aluminum and a release layer coating the tube. The fixing roller 40 is rotatably supported by the mount such as the frame. Inside the tube of the fixing roller 40 is the heater 42 such as a halogen lamp that heats the fixing roller 40. Heat generated by the heater 42 is conducted through the fixing roller 40 to the unfixed toner image on the recording medium P conveyed through the fixing nip N.

In proximity to the fixing roller 40 is a fixing roller temperature sensor 41 that detects the temperature of the fixing roller 40. The heater 42 is controlled based on the temperature of the fixing roller 40 that is detected by the fixing roller temperature sensor 41. For example, the fixing roller temperature sensor 41 is a thermistor.

A description is provided of a construction of a comparative fixing device.

The comparative fixing device includes a fixing roller and a pressure roller pressed against the fixing roller to form a fixing nip therebetween. As a recording medium bearing an unfixed toner image is conveyed through the fixing nip, the fixing roller and the pressure roller melt and fix the toner image on the recording medium. A surface of the fixing roller is treated with fluorine coating or the like to prevent toner of the toner image on the recording medium from adhering to the fixing roller.

When the recording medium enters the fixing nip, the recording medium may crease according to various conditions such as the type of the recording medium, an environment where the comparative fixing device is located, and the property of the toner image. For example, if a guide (e.g., an entry guide plate) that guides the recording medium to the fixing nip is situated excessively low relative to the fixing nip, the recording medium is susceptible to creasing. Conversely, if the guide is situated excessively high relative to the fixing nip, a trailing edge of the recording medium in a recording medium conveyance direction is bent upward and the toner image on the recording medium comes into contact with a component disposed in a conveyance path, causing the component to scratch the toner image on the recording medium.

To address this circumstance, the comparative fixing device may employ a movable guide that moves according to the type of the recording medium to improve conveyance of the recording medium. For example, the movable guide is supported by and pivotable about a rotation shaft to move between a first position and a second position in accordance with pressure exerted from the recording medium. The movable guide is divided into an upstream guide and a downstream guide. However, a mechanism to mechanically switch the position of the movable guide is needed, increasing manufacturing costs.

While the guide guides the recording medium bearing the toner image transferred by a transfer device to the fixing nip, the toner image is electrostatically attracted to the recording medium as the recording medium is conveyed to the fixing nip. For example, the transfer device applies an electric charge having a polarity opposite a polarity of charged toner of the toner image formed on a front side of the recording medium to a back side of the recording medium. The toner image is attracted to the recording medium by a Coulomb force exerted between the charged toner of the toner image on the front side of the recording medium and the electric charge on the back side of the recording medium. Accordingly, an attraction force that attracts the charged toner of the toner image to the recording medium is unstable and the toner image is susceptible to degradation due to fluctuation in an amount of the electric charge carried by the back side of the recording medium. For example, if the electric charge on the back side of the recording medium decreases and therefore an electrostatic force that attracts the charged toner of the toner image to the recording medium decreases, the toner may scatter around, resulting in formation of a faulty toner image.

For example, if the resistance value of the recording medium increases in an environment of a low temperature and a low humidity or the like, as the recording medium slides over the guide, an electric field generates. The electric field scatters the toner attracted to the recording medium by the electrostatic force, resulting in degradation of the toner image on the recording medium, which is hereinafter referred to as image dust.

To address this circumstance, the comparative fixing device may incorporate a construction to prevent degradation of the toner image on the recording medium while the recording medium is conveyed through the conveyance path directed to the comparative fixing device. For example, the guide may include an upstream guide and a downstream guide. The upstream guide guides the recording medium to a position where the toner of the toner image electrostatically attracted to the recording medium is heated and melted. The downstream guide guides the recording medium to a position in proximity to the fixing nip while the toner of the toner image on the recording medium is melted.

However, the upstream guide and the downstream guide separated from each other and configured to move to change the position of the upstream guide and the downstream guide where they contact the recording medium so as to reduce image dust may complicate assembly of the comparative fixing device, increasing manufacturing costs.

To address those circumstances of the comparative fixing device, the guide 20 of the fixing device 10 depicted in FIG. 2 includes one or more rib-shaped projections extending in the recording medium conveyance direction DP and a contact face that comes into contact with the recording medium P. A roughened face is on at least a part of the contact face as described below.

A description is provided of a construction of the guide 20 according to a first exemplary embodiment.

Figure 3:
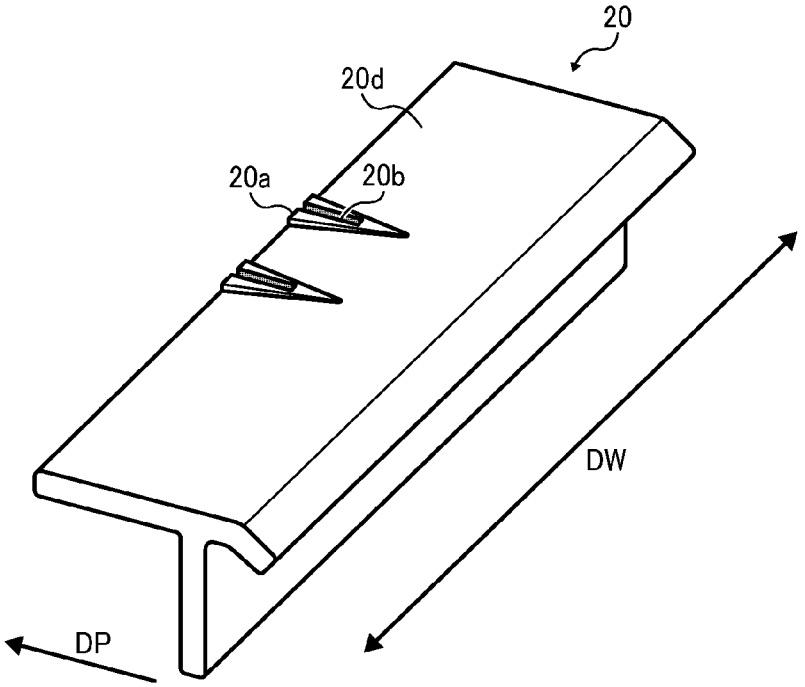
FIG. 3 is a perspective view of a guide according to a first exemplary embodiment that is incorporated in the fixing device illustrated in FIG. 2.

FIG. 3 is a perspective view of the guide 20 as one example of the guide 20 incorporated in the fixing device 10. As illustrated in FIG. 3, the guide 20 includes a rib-shaped projection 20*a* (e.g., a rib) and a slit-shaped groove 20*b* (e.g., a groove or a slit) disposed on the projection 20*a* and extended in the recording medium conveyance direction DP. The groove 20*b* reduces an amount of an electric charge accumulated on a tip of the projection 20*a*, reducing generation of image dust.

FIG. 4 is a cross-sectional view of the guide 20 in a width direction DW thereof depicted in FIG. 3 that is perpendicular to the recording medium conveyance direction DP, illustrating the projection 20*a* and the groove 20*b*. As illustrated in FIG. 4, the groove 20*b* includes a surface, roughened face M. For example, the roughened face M is produced by emboss processing. The roughened face M reduces generation of image dust effectively.

FIG. 5 is a lookup table illustrating a relation between a surface roughness Ra of the roughened face M by emboss processing and a degree of reduction of generation of image dust. In the lookup table in FIG. 5, "GOOD" denotes no generation of image dust. "FAIR" denotes slight generation of image dust. "POOR" denotes apparent generation of image dust. As illustrated in FIG. 5, if the surface roughness Ra of the roughened face M produced by emboss processing is 1 micrometer or greater, generation of image dust is suppressed. Hence, a surface of the groove 20*b* is produced by emboss processing into the roughened face M that has the surface roughness Ra of 1 micrometer or greater.

A description is provided of an evaluation on a relation between the width of the projection 20*a* and the groove 20*b* and reduction of generation of image dust and a relation between the height of the projection 20*a* and the depth of the groove 20*b* and reduction of generation of image dust.

FIG. 6 is a perspective view of the projection 20*a* and the groove 20*b*. As illustrated in FIG. 6, the projection 20*a* has a width L in the width direction DW perpendicular to the recording medium conveyance direction DP and a height Lh in a height direction DH perpendicular to the recording medium conveyance direction DP and the width direction DW with respect to a surface of the guide face 20*d*. Similarly, the groove 20*b* has a width S in the width direction DW perpendicular to the recording medium conveyance direction DP and a depth Sh in the height direction DH perpendicular to the recording medium conveyance direction DP and the width direction DW with respect to the surface of the guide face 20*d*.

Figure 7:
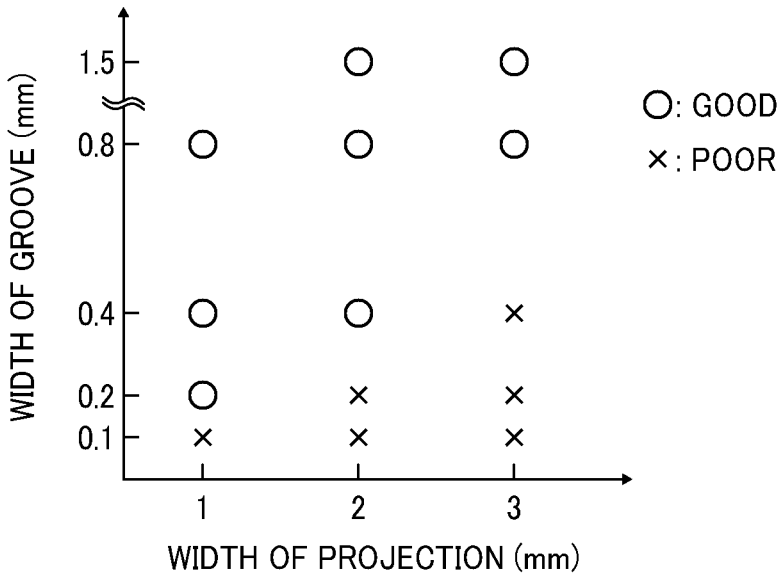
FIG. 7 is a graph illustrating a relation between a width of the projection and a width of the groove illustrated in FIG. 6.

FIG. 7 is a graph illustrating a relation between the width L of the projection 20*a* and the width S of the groove 20*b*. In the lookup table in FIG. 7, "GOOD" denotes no generation of image dust and "POOR" denotes apparent generation of image dust. As illustrated in FIG. 7, generation of image dust is suppressed effectively when a rate S/L of the width S of the groove 20*b* to the width L of the projection 20*a* is in a range of from 0.2 to 0.8. That is, the preferable rate S/L is defined by a formula (1) below.

$$0.2 \leq S/L \leq 0.8 \quad (1)$$

Figure 8:
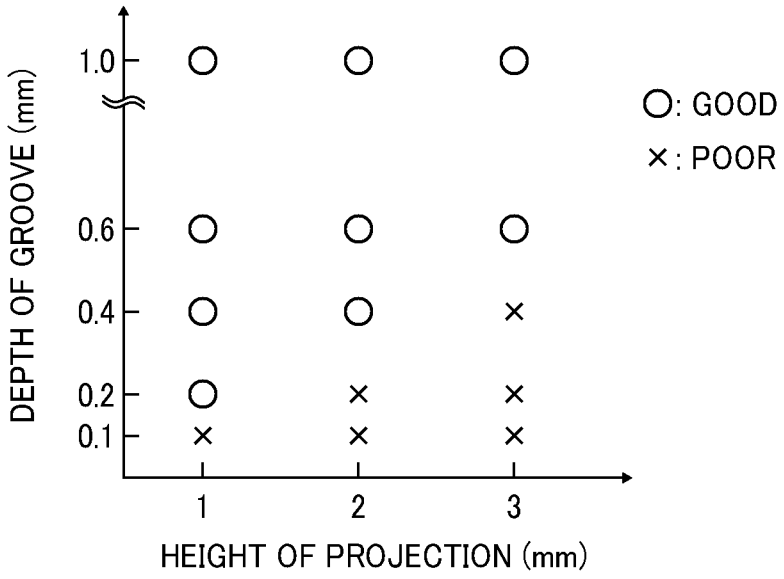
FIG. 8 is a graph illustrating a relation between a height of the projection and a depth of the groove illustrated in FIG. 6.

FIG. 8 is a graph illustrating a relation between the height Lh of the projection 20*a* and the depth Sh of the groove 20*b*. In the lookup table in FIG. 8, "GOOD" denotes no generation of image dust and "POOR" denotes apparent generation of image dust. As illustrated in FIG. 8, generation of image dust is suppressed effectively when a rate Sh/Lh of the depth Sh of the groove 20*b* to the height Lh of the projection 20*a* is in a range of from 0.2 to 1.0. That is, the preferable rate Sh/Lh is defined by a formula (2) below.

$$0.2 \leq Sh/Lh \leq 1.0 \quad (2)$$

A description is provided of a construction of a guide 20S according to a second exemplary embodiment.

Figure 9:
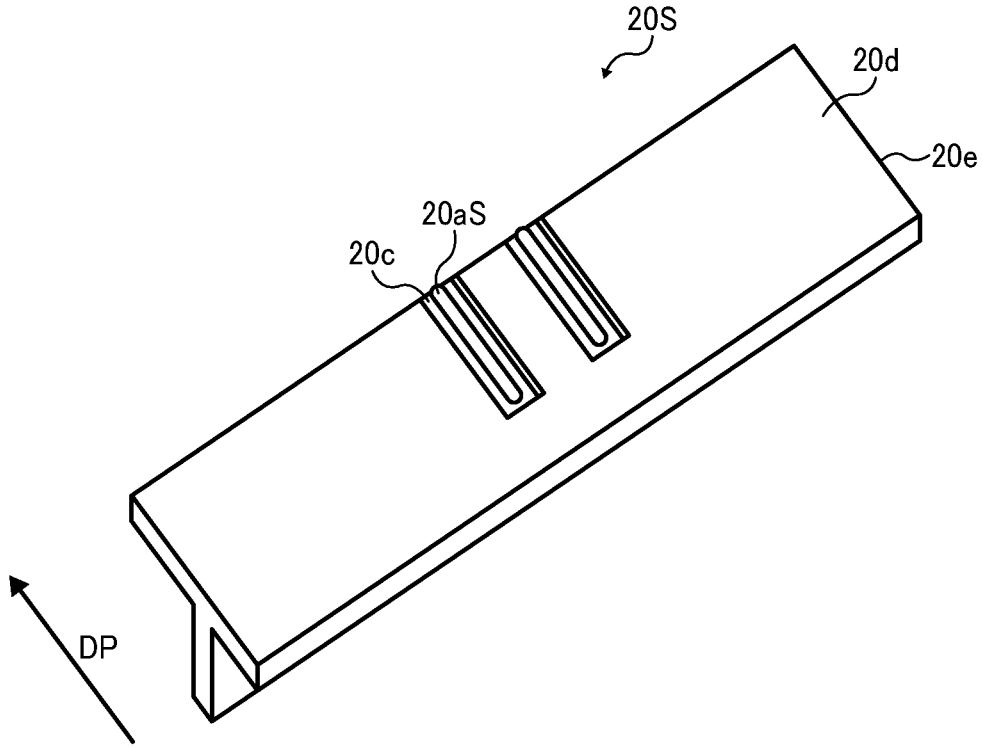
FIG. 9 is a perspective view of a guide according to a second exemplary embodiment that is installable in the fixing device illustrated in FIG. 2.

FIG. 9 is a perspective view of the guide 20S as one example of the guide 20S installable in the fixing device 10 depicted in FIG. 2. As illustrated in FIG. 9, the guide 20S includes a body 20*e* having a guide face 20*d* and a separate section 20*c* having a projection 20*a*S. The separate section 20*c* is coupled with the body 20*e*. The guide face 20*d* serving as a surface that comes into contact with the recording medium P is made of liquid crystal polymer (LCP). The heat resistant LCP reduces thermal deformation of the guide face 20*d*, achieving the guide 20S that is immune from warping or the like and improves stability in dimensional precision. The guide face 20*d* attaining an improved stability in dimensional precision reduces creasing of the recording medium P conveyed through the fixing device 10, improving conveyance of the recording medium P.

The projection 20*a*S serving as the separate section 20*c* is made of a material different from a material of the guide face 20*d*. The projection 20*a*S is made of a material other than LCP to reduce the amount of the electric charge accumulated on the tip of the projection 20*a*S, thus suppressing generation of image dust. For example, the projection 20*a*S is made of a material that increases the surface roughness of the projection 20*a*S compared to at least the surface roughness of the guide face 20*d* to allow the projection 20*a*S to have a roughened face.

The projection 20*a*S is made of a material having a volume resistivity smaller than a volume resistivity of the body 20*e*. That is, the projection 20*a*S is made of a material having a volume resistivity smaller than a volume resistivity of 1.0E13 Ω·cm of LCP of the guide face 20*d*. For example, the projection 20*a*S is made of heat resistant resin such as polyethyleneterephthalate (PET) containing glass and polyphenylenesulfide (PPS). The tip of the projection 20*a*S made of the material having the decreased volume resistivity is accumulated with a decreased amount of the electric charge by frictional charging while the recording medium P is conveyed through the fixing device 10, thus suppressing generation of image dust.

Figure 10A:
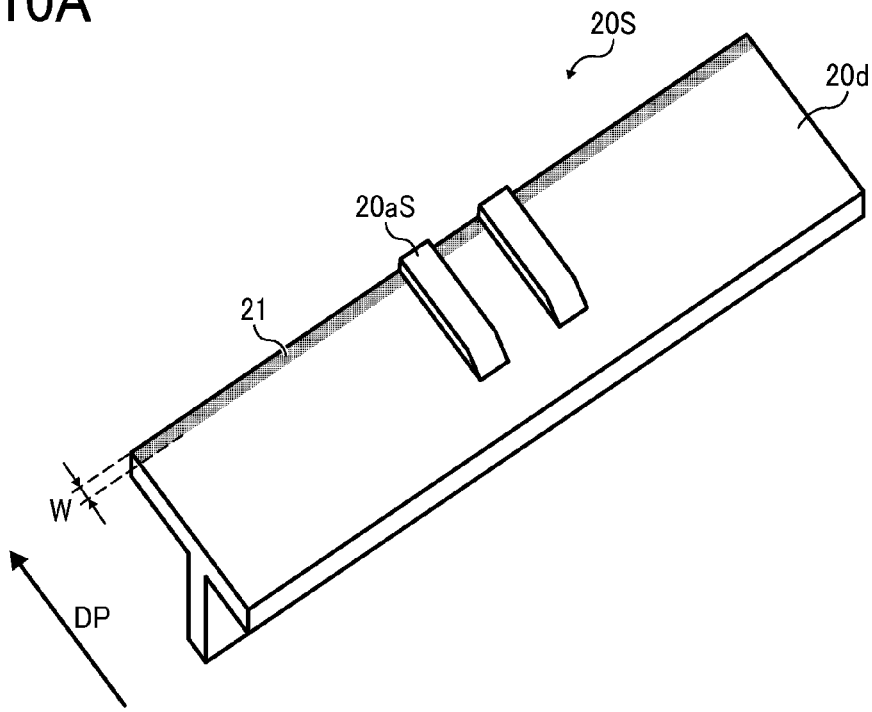
FIG. 10A is a perspective view of the guide depicted in FIG. 9 illustrating a projection attached to a guide face incorporated in the guide.
Figure 10B:
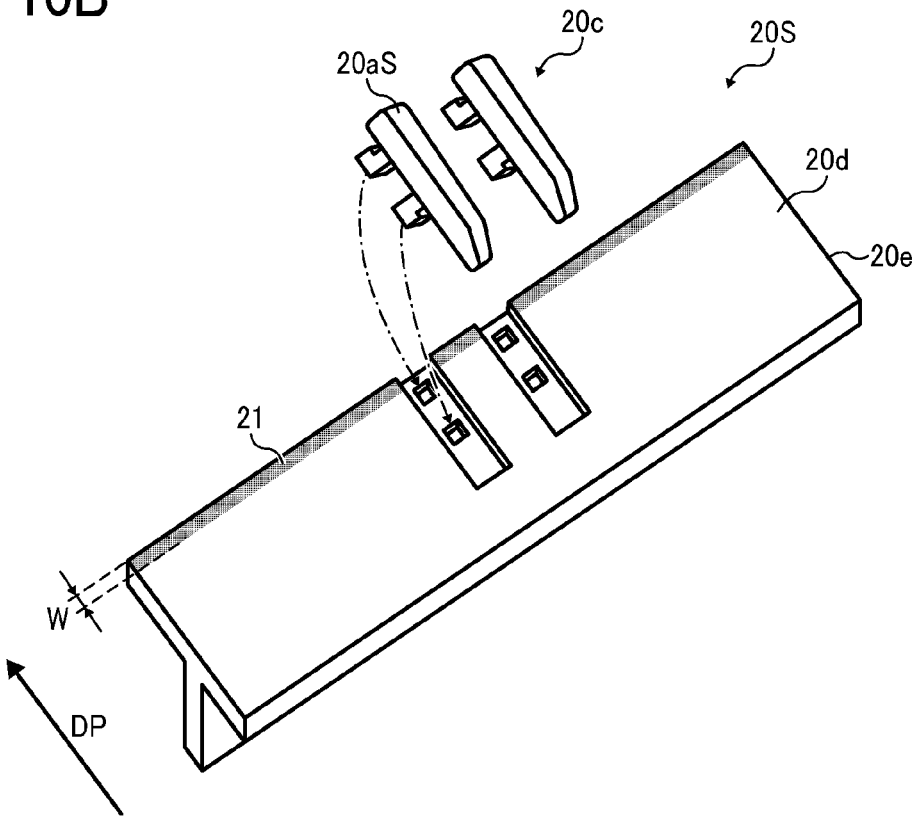
FIG. 10B is a perspective view of the guide depicted in FIG. 10A illustrating the projection detached from the guide face.
Figure 11A:
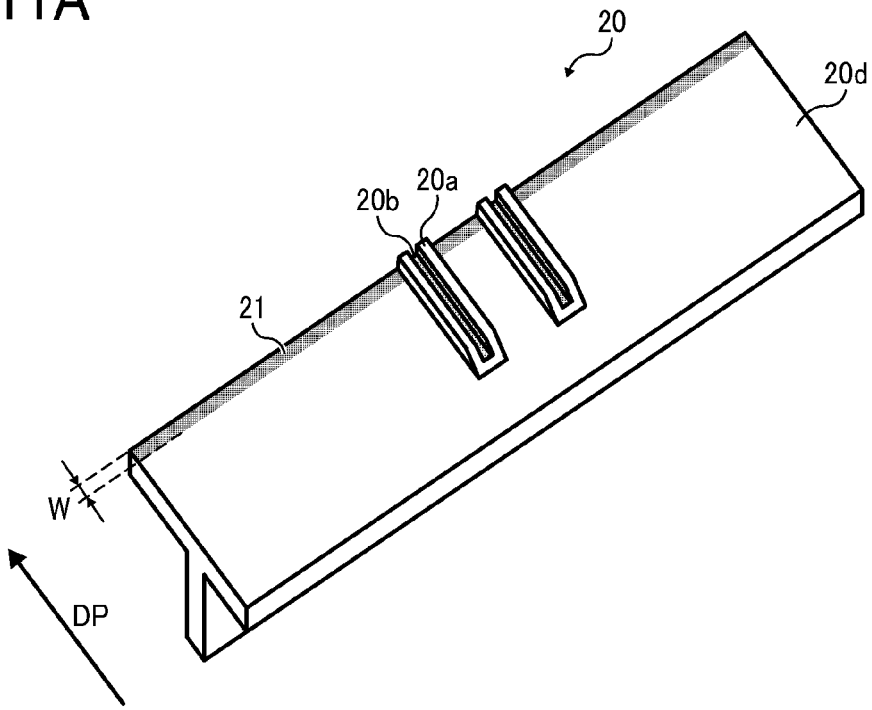
FIG. 11A is a perspective view of the guide depicted in FIG. 3 illustrating the projection attached to the guide face incorporated in the guide.
Figure 11B:
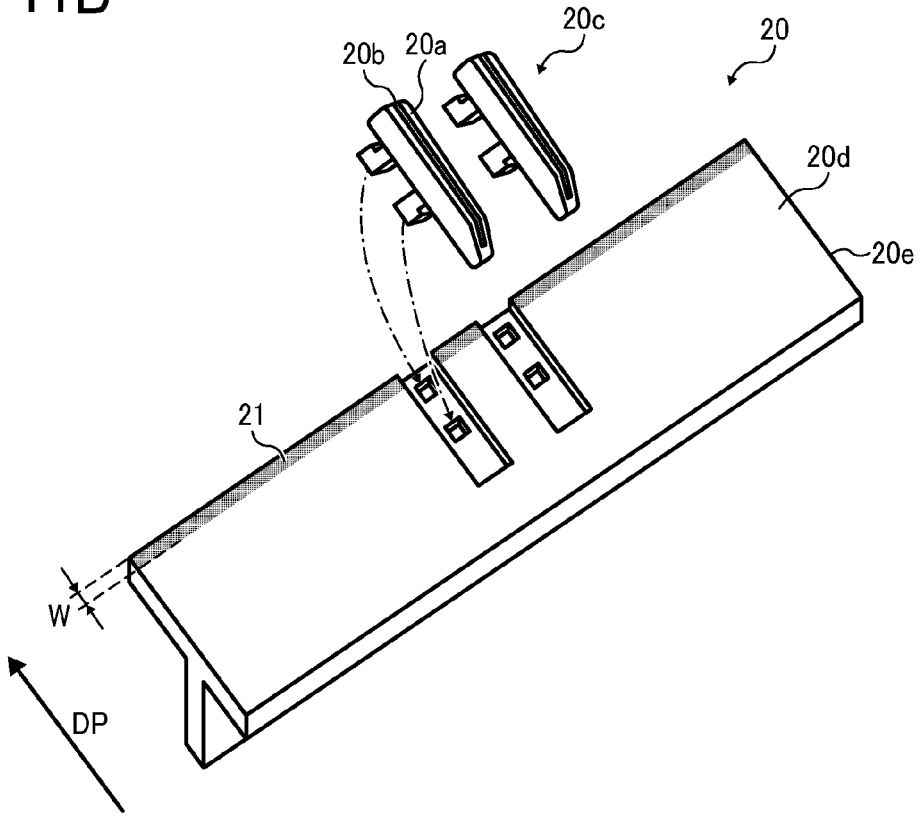
FIG. 11B is a perspective view of the guide depicted in FIG. 11A illustrating the projection detached from the guide face.

The projection 20*a*S serving as the separate section 20*c* is detachably attached to the guide face 20*d* as illustrated in FIGS. 10A and 10B. FIG. 10A is a perspective view of the guide 20S illustrating the projection 20*a*S attached to the guide face 20*d*. FIG. 10B is a perspective view of the guide 20S illustrating the projection 20*a*S detached from the guide face 20*d*. Similarly, the projection 20*a* may serve as the separate section 20*c* detachably attached to the guide face 20*d* as illustrated in FIGS. 11A and 11B. FIG. 11A is a perspective view of the guide 20 illustrating the projection 20*a* attached to the guide face 20*d*. FIG. 11B is a perspective view of the guide 20 illustrating the projection 20*a* detached from the guide face 20*d*. As illustrated in FIGS. 10B and 11B, each of the projections 20*a* and 20*a*S serving as the separate section 20*c* is manufactured under a simple assembly process and readily attached to the body 20*e*.

As illustrated in FIGS. 10A, 10B, 11A, and 11B, each of the projections 20*a* and 20*a*S includes a roughened strip 21 disposed at a downstream end, that is, a front end, of the guide face 20*d* in the recording medium conveyance direction DP. The roughened strip 21 is treated with emboss processing and has a length W in the recording medium conveyance direction DP. The roughened strip 21 treated with emboss processing contacts the recording medium P in a decreased area that reduces charging. The roughened strip 21 disposed at the front end of the guide face 20*d* suppresses accumulation of the electric charge on the front end of the guide face 20*d* effectively, thus suppressing generation of image dust.

FIG. 5 illustrates the relation between the surface roughness Ra of the roughened strip 21 mounted on the guide face 20*d* and the degree of reduction of image dust. FIG. 5 illustrates an evaluation performed in an environment of a low temperature of 10 degrees centigrade and a low humidity of 15 percent. As illustrated in FIG. 5, if the surface roughness Ra of the roughened strip 21 produced by emboss processing is 1 micrometer or greater, generation of image dust is suppressed. If the surface roughness Ra of the roughened strip 21 produced by emboss processing is 0.5 micrometers or smaller, image dust generates on the recording medium P having an increased resistance value. Hence, it is preferable that the surface roughness Ra of the roughened strip 21 mounted on the guide face 20*d* is 1 micrometer or greater.

Figures 12, 13, 14:
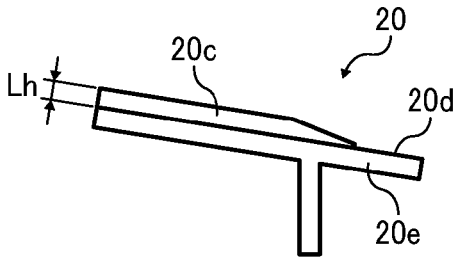
FIG. 12 is a lookup table illustrating a relation between emboss processing and reduction of image dust that varies depending on the material of the projection of the respective guides depicted in FIGS. 3 and 9.
FIG. 13 is a cross-sectional view of the respective guides depicted in FIGS. 3 and 9 illustrating a separate section attached to a body incorporated in the respective guides.
FIG. 14 is a lookup table illustrating a relation between creasing and image scratch that varies depending on the height of the respective projections depicted in FIGS. 10A and 11A.

FIG. 12 is a lookup table illustrating a relation between emboss processing and reduction of image dust that varies depending on the material of the projections 20*a* and 20*a*S. YES in the "EMBOSS PROCESSING" column denotes that the roughened strip 21 having the surface roughness Ra of 1.5 micrometers is disposed at the downstream end, that is, the front end, of the guide face 20*d* in the recording medium conveyance direction DP. PET in the "MATERIAL OF PROJECTION" column denotes PET containing glass. "GOOD" in the "REDUCTION OF IMAGE DUST" column denotes no generation of image dust. "POOR" in the "REDUCTION OF IMAGE DUST" column denotes apparent generation of image dust.

As illustrated in FIG. 12, with the projections 20*a* and 20*a*S made of LCP, if the projections 20*a* and 20*a*S did not have the roughened strip 21 treated with emboss processing, the projections 20*a* and 20*a*S were accumulated with the electric charge by friction between the projections 20*a* and 20*a*S and the recording medium P sliding thereover, generating image dust. Conversely, with the projections 20*a* and 20*a*S made of PET containing glass, regardless of whether or not the projections 20*a* and 20*a*S had the roughened strip 21 treated with emboss processing, image dust did not generate. It is presumed that a surface of the respective projections 20*a* and 20*a*S made of PET containing glass serves as the roughened strip 21.

FIG. 13 is a cross-sectional view of the guide 20 illustrating the separate section 20*c* attached to the body 20*e*. The separate section 20*c* represents the respective projections 20*a* and 20*a*S having the height Lh.

FIG. 14 is a lookup table illustrating a relation between creasing and image scratch that varies depending on the height Lh of the respective projections 20*a* and 20*a*S. YES in the "CREASING" column denotes that the recording medium P suffers from creasing when the recording medium P enters the fixing nip N. Conversely, NO in the "CREASING" column denotes that the recording medium P does not suffer from creasing. YES in the "IMAGE SCRATCH" column denotes that a trailing edge of the recording medium P in the recording medium conveyance direction DP is bent upward and a toner image on the recording medium P comes into contact with a component disposed in a conveyance path, causing the component to scratch the toner image on the recording medium P. Conversely, NO in the "IMAGE SCRATCH" column denotes that the toner image on the recording medium P is not scratched.

As illustrated in FIG. 14, it is preferable that the height Lh of the respective projections 20*a* and 20*a*S is in an allowable range of from 0.5 mm to 1.5 mm in which the recording medium P is immune from creasing and image scratch.

A description is provided of advantages of the fixing device 10.

As illustrated in FIG. 2, the fixing device 10 includes a fixing rotator (e.g., the fixing roller 40) rotatable in a predetermined direction of rotation (e.g., the rotation direction D40) and a pressure rotator (e.g., the pressure roller 50) to press against the fixing rotator to form the fixing nip N therebetween. As a recording medium P bearing an unfixed toner image is conveyed through the fixing nip N, the fixing rotator and the pressure rotator fix the toner image on the recording medium P. As illustrated in FIGS. 2, 3, and 9, a guide (e.g., the guides 20 and 20S) is disposed upstream from the fixing nip N in the recording medium conveyance direction DP to guide the recording medium P to the fixing nip N. The guide includes at least one rib-shaped projection (e.g., the projections 20*a* and 20*a*S) extending in the recording medium conveyance direction DP. As illustrated in FIGS. 4, 10A, and 11A, the guide further includes a contact face (e.g., the guide face 20*d*) to come into contact with the recording medium P and a roughened face (e.g., the roughened face M and the roughened strip 21) mounted on at least a part of the contact face.

Thus, the fixing device 10 incorporates the guide that improves conveyance of the recording medium P and prevents generation of image dust with a simple mechanism and a simple assembly process at reduced manufacturing costs.

According to the exemplary embodiments described above, the fixing roller 40 serves as a fixing rotator. Alternatively, a fixing belt, a fixing film, a fixing sleeve, or the like may be used as a fixing rotator. Further, the pressure roller 50 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator to press against the fixing rotator to form a fixing nip between the fixing rotator and the pressure rotator, the fixing nip through which a recording medium bearing a toner image is conveyed; and a guide, disposed upstream from the fixing nip in a recording medium conveyance direction, to guide the recording medium to the fixing nip, the guide including:

a projection extending in the recording medium conveyance direction;

a contact face to come into contact with the recording medium; and a roughened face disposed on at least a part of the contact face.

2. The fixing device according to claim 1, wherein the projection includes a rib.

3. The fixing device according to claim 1, wherein the guide further includes a groove being disposed on the projection and extending in the recording medium conveyance direction.

4. The fixing device according to claim 3, wherein the groove includes a slit.

5. The fixing device according to claim 3, wherein the roughened face is a surface of the groove, the surface being treated with emboss processing and having a surface roughness not smaller than 1 micrometer.

6. The fixing device according to claim 3, wherein the groove has a groove width in a width direction perpendicular to the recording medium conveyance direction and the projection has a projection width in the width direction, and wherein a rate of the groove width to the projection width is in a range of from 0.2 to 0.8.

7. The fixing device according to claim 6, wherein the groove has a groove depth in a height direction perpendicular to the recording medium conveyance direction and the width direction and the projection has a projection height in the height direction, and wherein a rate of the groove depth to the projection height is in a range of from 0.2 to 1.0.

8. The fixing device according to claim 7, wherein the projection height is in a range of from 0.5 mm to 1.5 mm.

9. The fixing device according to claim 1,
wherein the contact face of the guide is made of liquid crystal polymer.

10. The fixing device according to claim 1,
wherein the guide further includes a body separated from the projection.

11. The fixing device according to claim 10,
wherein the projection is made of a material having a volume resistivity that is smaller than a volume resistivity of the body.

12. The fixing device according to claim 1,
wherein the guide further includes another projection extending in the recording medium conveyance direction and being aligned with the projection in a width direction perpendicular to the recording medium conveyance direction.

13. The fixing device according to claim 1,
wherein the roughened face includes a strip being disposed at a downstream end of the contact face in the recording medium conveyance direction and extending in a width direction perpendicular to the recording medium conveyance direction.

14. The fixing device according to claim 13,
wherein the strip is treated with emboss processing and has a surface roughness not smaller than 1 micrometer.

15. The fixing device according to claim 1,
wherein the projection is detachably attached to the contact face.

16. An image forming apparatus comprising:
an image forming device to form a toner image; and
a fixing device, disposed downstream from the image forming device in a recording medium conveyance direction, to fix the toner image on a recording medium,
the fixing device including:
a fixing rotator rotatable in a predetermined direction of rotation;
a pressure rotator to press against the fixing rotator to form a fixing nip between the fixing rotator and the pressure rotator, the fixing nip through which the recording medium bearing the toner image is conveyed; and
a guide, disposed upstream from the fixing nip in the recording medium conveyance direction, to guide the recording medium to the fixing nip,
the guide including:
a projection extending in the recording medium conveyance direction;
a contact face to come into contact with the recording medium; and
a roughened face disposed on at least a part of the contact face.

17. A fixing device comprising:
a fixing rotator;
a pressure rotator configured to press against the fixing rotator to form a fixing nip between the fixing rotator and the pressure rotator, the fixing nip being configured to convey a recording medium bearing a toner image therethrough; and
a guide, upstream from the fixing nip in a recording medium conveyance direction, configured to guide the recording medium to the fixing nip,
the guide including:
at least one rib-shaped projection extending in a recording medium conveyance direction;
a slit-shaped groove on the at least one rib-shaped projection and extending in the recording medium conveyance direction; and
a contact face in contact with the recording medium.

18. The fixing device according to claim 17, wherein:
the at least one rib-shaped projection includes,
a first projection; and
a second projection adjacent to the first projection; and
an interval (A) between the first projection and the second projection in an axial direction of the fixing rotator is smaller than a distance (B) from a lateral edge of the guide to the first projection in the axial direction of the fixing rotator.

19. The fixing device according to claim 18, wherein the first projection is parallel to the second projection.

20. The fixing device according to claim 17, wherein the at least one rib-shaped projection includes a slope at an upstream part thereof in the recording medium conveyance direction.

21. The fixing device according to claim 17, wherein the at least one rib-shaped projection includes a first part and a second part on opposite sides of the slit-shaped groove in an axial direction of the fixing rotator.

22. The fixing device according to claim 21, wherein each of the first part and the second part includes:
a first wall; and
a second wail opposite and parallel to the first wall.

23. An image forming apparatus comprising the fixing device according to claim 17.

24. A guide configured to guide a recording medium in a fixing device, the guide comprising:
at least one rib-shaped projection extending in a recording medium conveyance direction;
a slit-shaped groove on the at least one rib-shaped projection and extending in the recording medium conveyance direction; and
a contact face configured to contact the recording medium;
the slit-shaped groove having a surface roughness equal to or greater than about 1.0 μm.

* * * * *